United States Patent [19]

Post

[11] Patent Number: 5,019,126

[45] Date of Patent: May 28, 1991

[54] FOLDABLE CLOTHES HANGER RAIL SYSTEM

[76] Inventor: Steven W. Post, 3310 Redwood Cove, Jonesboro, Ark. 72401

[21] Appl. No.: 486,727

[22] Filed: Mar. 1, 1990

[51] Int. Cl.[5] ..... A47F 5/00

[52] U.S. Cl. ..... 211/104; 211/99; 211/100

[58] Field of Search ..... 211/104, 99, 105.1, 211/100, 123

[56] References Cited

U.S. PATENT DOCUMENTS

| | | | |
|---|---|---|---|
| 971,493 | 9/1910 | Crane | 211/99 |
| 978,423 | 12/1910 | Zizinia | 211/99 |
| 2,582,320 | 1/1952 | Evans | 211/104 X |
| 2,662,645 | 12/1953 | Piton | 211/104 X |
| 3,211,295 | 10/1965 | Weiss | 211/104 X |

*Primary Examiner*—Robert W. Gibson, Jr.

[57] ABSTRACT

A foldable clothes hanger rail system that consist of a clothes hanger rail that is retractable when not in use. The foldable clothes hanger rail system was developed for applications such as laundry rooms where a permanent clothes hanger rail takes up too much room and is only needed on an intermittent basis. The rail is made retractable by having the rail attached to pivot members that pivot around screws fastened into a wall mountable frame. The pivot members are supported by chords or chains running from the upper portion of the frame and support the rail when it is rotated downward and in service. A rail clip is provided on the upper portion of the frame to keep the rail retracted when not in ervice. The entire system is made into one single unit to be easily mounted on a wall.

2 Claims, 1 Drawing Sheet

FOLDABLE CLOTHES HANGER RAIL SYSTEM

FIELD OF INVENTION

Figure 1:
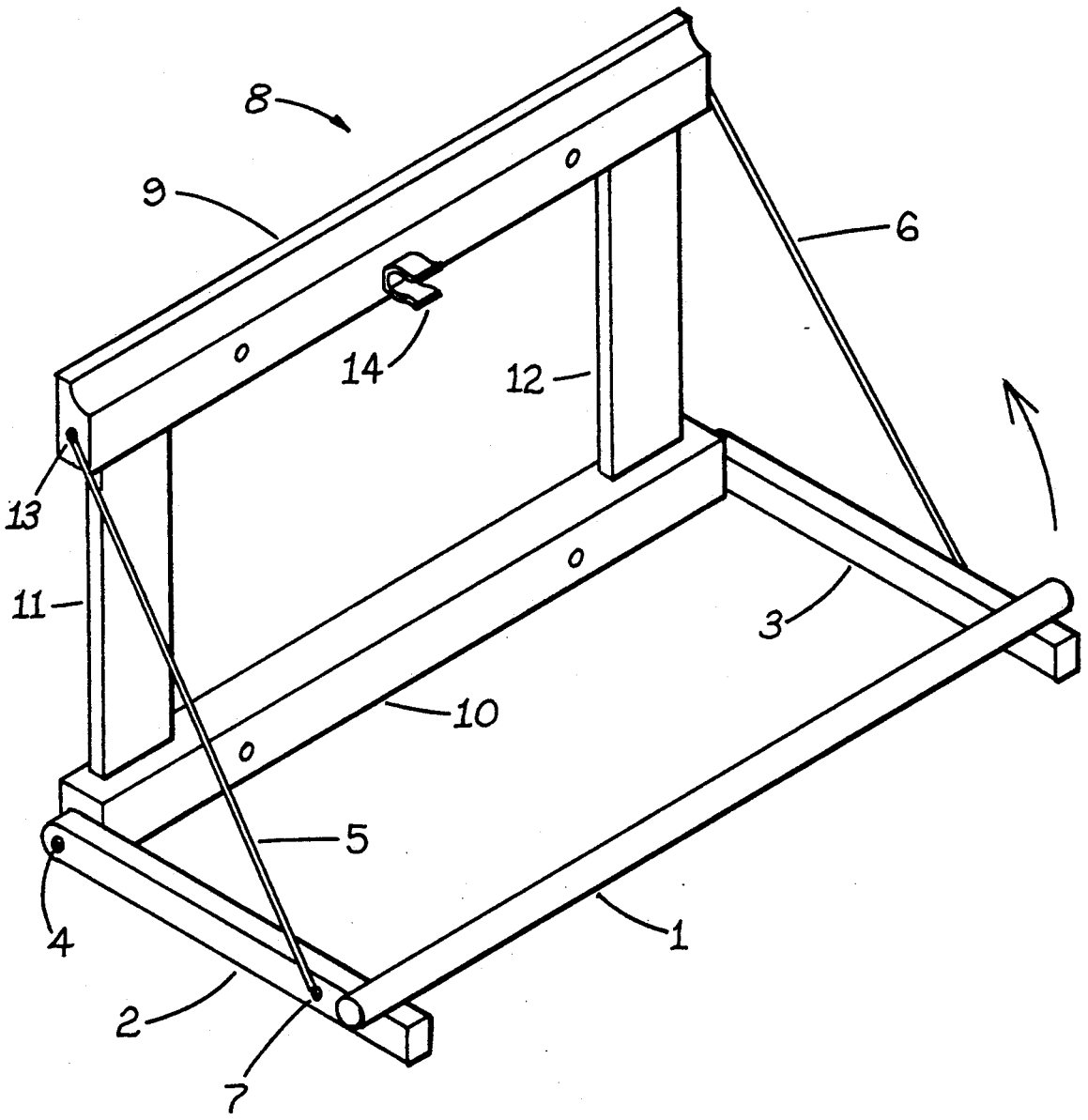

This invention relates to clothes hanger rails, and more particularly to clothes hanger rail systems that have retractable and protractable rails that fold up when not in use so as not to take room when not needed.

DISCUSSION OF PRIOR ART

Heretofore clothes hanger rails were always designed and fabricated to be passive devices which remained in place when not required. In many situations this did and still does not poise a problem. However in the laundry room in most modest homes it poises a considerable problem. These laundry rooms are typically very small, and quite often are situated in a place where a permanent clothes hanger rail is obviously impracticable. The end result is door knobs and door frames are used to hang the clothes on when taking clothes out of the dryer, instead of installing a normal non-foldable hanger rail system from the local hardware store for an application that requires a hanger rail to be available only intermittently, and out of the way when not in use.

OBJECTS

Accordingly the objects of my invention are to provide a clothes hanger rail system that may be mounted on a wall, with a protractable rail that rotates down when required for service.

Furthermore the rail may be retracted up and out of the way when not required and remains in the up position. The clothes hanger rail system will be built upon a frame for ease of installation. Further objects and advantages of my invention will become apparent from a consideration of the drawings and ensuing description thereof.

DRAWINGS

FIG. 1 is a full isometric view of the foldable clothes hanger rail system. The hanger rail is pictured in the down or protracted position ready for clothes to be hung.

DESCRIPTION

Referring more particularly to the drawing, the foldable clothes hanger system consist of a rail 1 securely glued or fasten to pivot members 2 and 3. The pivot members pivot around screws of which one is labeled as 4. The screws fit into clearance holes in the pivot members 2 and 3 and are fastened into the frame 8.

The pivot members also have one end of a chord or chain 5 and 6 attached onto a screw or pin of which one is labeled as 7.

The frame 8 consist of an upper horizontal member 9, a lower horizontal member 10 and two vertical members 11 and 12. The four members are glued or fastened to make a sturdy framework. Mounting holes are located in the upper and lower horizontal members.

The opposite end of the chain or chord 5 that was attached to the pivot members 2 and 3 is attached to the upper horizontal member 9 to support the rail and pivot members when rotated downward by screws of which one is labeled 13.

A rail clip 14 is fastened in the center of the upper horizontal member to hold the rail when it is in the folded or upright position. This clip would typically be made of zinc plated spring steel.

OPERATION

The foldable clothes hanger rail system is mounted to any house hold or commercial business wall by using the mounting holes located in the frame.

The rail is used for hanging clothes by pulling the rail free from the clip and allowing it to rotate down until the chords or chains are tight. Gravity holds the rail in the down or protracted position. The pivot screws 4 allow the pivot members to rotate and the rigidity of the frame keeps the pivot members parallel. The chords or chains support the pivot members and rail assembly and are of the correct length to keep the rail in the position shown in FIG. 1. Clothes on a hanger may now be hung on the rail.

The rail is returned to its storage position be lifting the rail in a radial manner which causes the pivot members to pivot on the pivot screws and the rail follows a circular path until it snaps into the clip. The chords or chains hang loosely at the sides of the frame. The foldable hanger rail is now up and out of the way and gives the occupants the room they need.

While the above description contains many specifications, these should not be construed as limitations on the scope of the invention, but rather as an exemplication of one preferred embodiment thereof. Many other variations are possible, for example the frame could easily be a solid piece of wood for addition aesthetics or the clip could be replaced with a magnet and the rail could have a steel striker attached to it to hold the rail in the upright position. Furthermore the foldable clothes hanger rail system could use a method other than pivot members to enable the rail to be retracted and protracted. Accordingly, the scope of the invention should be determined not by the embodiment illustrated, but by the appended claims and their legal equivalents.

What is claimed is:

1. A rail system suitable for holding a plurality of conventional clothes hangers comprising:

a rectangular frame capable of being securely mounted on a wall;

a pair of pivot members pivotally secured to said frame and moveable between a stored position adjacent said frame and an operable position extending outward therefrom;

a single rail fixedly mounted on and extending between said members, said rail and members defining an open space therebetween to permit hangers to engage said rail from a wide range of angles;

a pair of flexible cords secured to each of the members and the frame to hold said members in said operable position; and means for releaseably holding said rail and said members in said stored position.

2. The invention according to claim 1 wherein said rail is cylindrical to facilitate engagement with the hangers and extends beyond said members to accept items which are not readily accepted by conventional hangers.

* * * * *